US007462040B1

(12) United States Patent
Takada

(10) Patent No.: US 7,462,040 B1
(45) Date of Patent: Dec. 9, 2008

(54) ELECTRICAL CONNECTOR FOR CIRCUIT BOARD

(75) Inventor: Toshiyuki Takada, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/984,271

(22) Filed: Nov. 15, 2007

(30) Foreign Application Priority Data

Sep. 10, 2007 (JP) ..... 2007-234150

(51) Int. Cl.
*H01R 12/00* (2006.01)

(52) U.S. Cl. ..... 439/76; 439/689; 439/637

(58) Field of Classification Search ..... 439/76, 439/689, 637

See application file for complete search history.

(56) References Cited

U.S. PATENT DOCUMENTS 6,869,292 B2 * 3/2005 Johnescu et al. ..... 439/74

2005/0221682 A1 * 10/2005 Stoner ..... 439/689

FOREIGN PATENT DOCUMENTS

JP 2004-303576 10/2004

* cited by examiner

*Primary Examiner*—Truc T Nguyen
(74) *Attorney, Agent, or Firm*—Kubotera & Associates, LLC

(57) ABSTRACT

An electrical connector for a circuit board is provided with a relay member connection body and a relay member receiving body. The relay member connection body is provided with terminals and a terminal holding body to hold the terminals. The relay member receiving body is fitted into the relay member connection body and receives a relay member that is to be connected with the terminals. The relay member receiving body is provided with receiving grooves extending in the assemble direction to receive the relay member. One end side of the terminal is held, and a contact portion elastically bendable inward of the receiving groove is provided in the other end side of the terminal. A distal portion of the terminal on the other end side abuts against the relay member receiving body, so that the terminals receive pre-compression in an elastically bending direction of the contact portion.

8 Claims, 9 Drawing Sheets

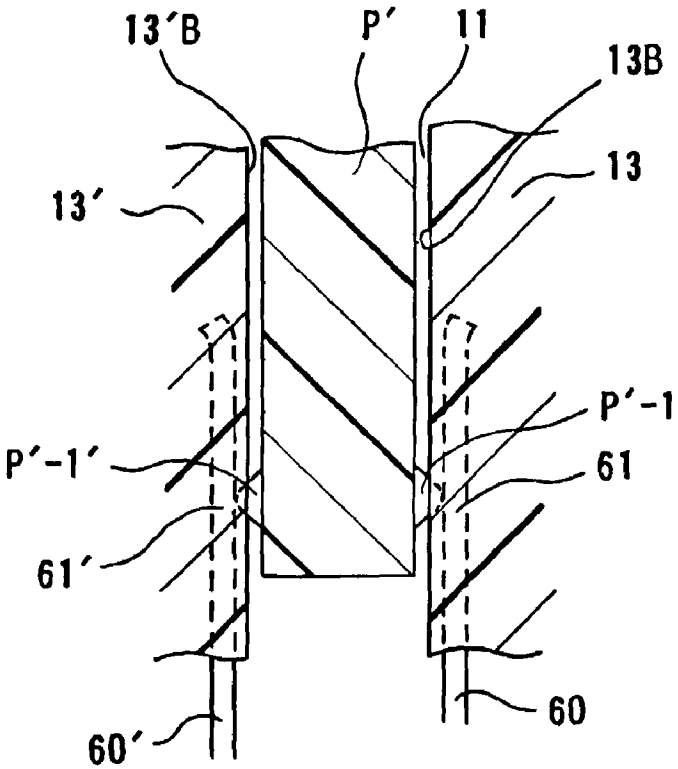
FIG. 8(B)
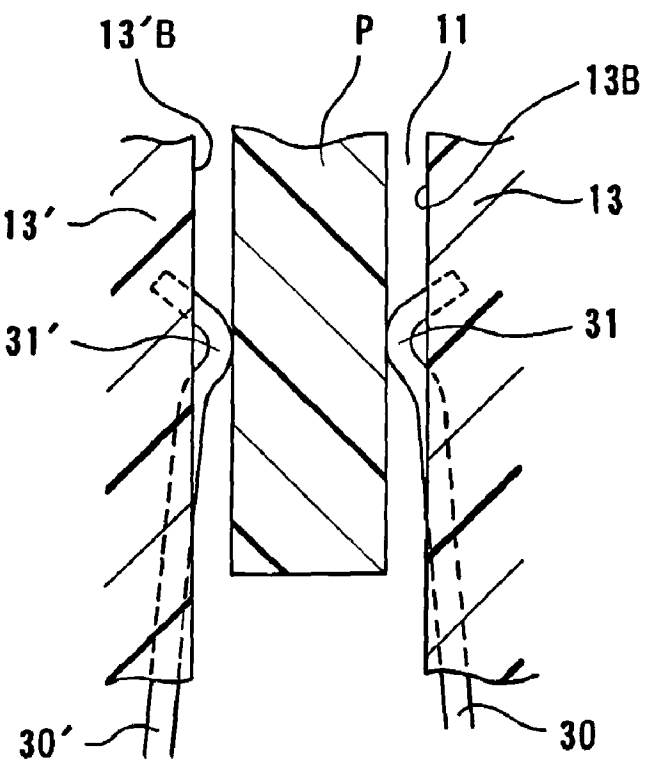
FIG. 8(A)
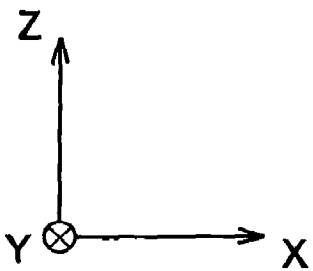

ELECTRICAL CONNECTOR FOR CIRCUIT BOARD

The present invention relates to an electrical connector for a circuit board.

A conventional connector attached to a circuit board may be connected to another connector attached to a different circuit board through a relay member having a transmission circuit on a surface thereof.

As the conventional connector connected through the relay member, for example, a connector disclosed in Patent Reference has been known. In the connector disclosed in Patent Reference, a plurality of divided connection bodies is attached to a housing from a lower portion thereof. A plurality of receiving grooves having an opening in an upper face is provided in the housing. A transmission circuit board as a relay member may be inserted into the receiving groove. Further, the divided connection body is provided with a plurality of terminals arranged in a row in a bar member made of an insulated material.

In the divided connection body, a plurality of pairs of the terminals is arranged in a longitudinal direction thereof. The pair of the terminals is facing each other in a longitudinal direction of the bar member or the divided connection body. The terminal passes through the bar member on an upper and a lower surface thereof. An elastic arm body having a contact portion protrudes from an upper face of the terminal, and a connection portion protrudes from a lower surface. The contact portion contacts with the transmission circuit board, and the connection portion is connected with a corresponding circuit portion of the circuit board.

The divided connection body is attached to the housing, so that a terminal arrangement direction or a longitudinal direction of the divided connection body, viewed from an upper portion of the connector, becomes perpendicular to a direction in which the receiving groove extends. The transmission circuit board may be inserted into the receiving groove formed in the housing. More specifically, the housing is provided with the receiving groove formed in series in a position corresponding with each pair of the terminals. A base portion of a pair of the elastic arm bodies facing each other in the divided connection body is pressed into the corresponding receiving groove, and is held by the housing.

Since the base portion of the elastic arm body is pressed into the receiving groove, the contact portion pair provided on a distal side of the elastic arm body of each pair is elastically bent and situated to face each other inside of the receiving groove. Accordingly, when the transmission circuit board is inserted into the receiving groove of the connector, the contact portion pair elastically contacts with connection pads through compressing the connection pads on the both surfaces of the transmission circuit board. The transmission circuit board has the transmission circuit and the connection pads on both surfaces. Further, the connection pad is an end portion of the transmission circuit.

Patent Reference Japanese Patent Publication No. 2004-303576

In the connector disclosed in Patent Reference, the terminal is pressed into the corresponding groove of the housing to assemble, and a contact with a transmission circuit board may be unstable due to a manufacturing error, a fitting error, and the like.

For example, when positions of the terminal and the corresponding receiving groove are displaced in a longitudinal direction of the divided connection body due to the errors mentioned above, and the terminal is forced to press into the receiving groove in the base portion of the elastic arm body, a position of the terminal may be inclined inside of the receiving groove. That is, an amount to interference with respect to a transmission circuit inside of the receiving groove of the contact portion pair facing each other may be uneven at the contact portions.

Accordingly, when the transmission circuit board is inserted into the receiving groove, a contact pressure between the contact portion and the connection pad of the transmission circuit board is not even on both surfaces of the transmission circuit board. As a result, a contact on a side with lower contact pressure becomes unstable.

Further, even though the connector is assembled without a manufacturing error or the like and a leaning of the terminal inside of the receiving groove, when the connector receives an external force while in use, a relative position of the terminal and the corresponding receiving groove may be displaced. As a result, as described above, a contact between the contact portion and the transmission circuit board may become unstable similar to the above example.

In view of the problems described above, an object of the present invention is to provide an electrical connector for a circuit board that has a stable contact with a relay member even though members are displaced each other.

Further objects and advantages of the invention will be apparent from the following description of the invention.

SUMMARY OF THE INVENTION

In order to attain the objects described above, according to the present invention, an electrical connector for a circuit board is provided with a relay member connection body and a relay member receiving body. The relay member connection body is provided with a plurality of terminals and a terminal holding body to arrange and hold the plurality of the terminals in rows. The relay member receiving body is fitted into the relay member connection body and receives a relay member that is to be connected with the terminals. The relay member receiving body is fitted into the terminal holding body in an assemble direction perpendicular to a terminal arrangement surface on which a plurality of the terminals held in the terminal holding body is arranged.

Further, the relay member receiving body is provided with a plurality of receiving grooves extending in the assemble direction thereof to receive the relay member. The terminal erects in a direction perpendicular to a terminal arrangement surface, and one end side of the terminals is held. Further, a contact portion that contacts with the relay member and may be elastically bent is provided inward of the receiving groove in the other end side of the terminal.

In the electrical connector for the circuit board, a distal portion of the terminal on the other end side thereof abuts against the relay member receiving body. Further, the plurality of the terminals receives pre-compression in a direction away from the relay member in an elastically bending direction of the contact portion.

In the electrical connector, the terminal abuts against the relay member receiving body and receives pre-compression in a direction away from the relay member (to be referred to as an "away direction") and the elastically bending direction of the contact portion. Accordingly, when the relay member receiving body is displaced from a regular position in the away direction of the relay member connection body, an adjacent portion with the relay member receiving body in the terminal is also displaced from a regular position to the away direction. As a result, the pre-compression is determined to be larger than that in the regular position.

On the other hand, when the relay member receiving body is displaced from the regular position with respect to the relay member connection body in a direction opposite to the away direction, an adjacent portion with the relay member receiving body in the terminal is also displaced from a regular position in the direction opposite to the away direction.

As a result, the pre-compression becomes smaller than that in the regular position. That is, even though the relay member receiving body is displaced in any of the away direction and the direction opposite to the away direction, the terminal receives the pre-compression. Accordingly, the contact portion always elastically contacts with the relay member and a minimum contact pressure between the contact portion and the relay member is always secured.

Further, the terminal receives the pre-compression in the distal portion on the other end side or a free edge of the terminal. Accordingly, comparing to when the terminal receives the pre-compression in other portion than the distal portion, the maximum deformation of the terminal may be larger. Further, the terminal elastically bends to secure a larger allowance for displacement.

At least one of the relay member connection body and the relay member receiving body may have an engagement portion and the other may have an engaged portion for fitting into each other. Further, at least one of the engagement portion and the engaged portion may be elastically bent in a direction perpendicular to both the assembly direction of the connector and the elastically bending direction of the contact portion. Further, it is preferred that the engagement portion engages with the engaged portion in the assembly direction thereof with a play.

At least one of the engaged portion and the engagement portion may be elastically bent in a direction perpendicular to both the assembly direction of the connector and the elastically bending direction of the contact portion. Accordingly, even though the relay member receiving body is displaced from a regular position in the direction of the relay member connection body, the engaged portion is bent in the direction. As a result, an impact of displacement may be absorbed.

Further, the engagement portion engages with the engaged portion in the assembly direction of the connector with a play. Accordingly, even though the relay member receiving body is displaced from the regular position of the relay member connection body in the assembly direction of the connector, an impact of displacement may be absorbed due to the play. Accordingly, in the electrical connector with the configuration described above can manage all displacements occurred in the three directions perpendicular to one another in three dimensions.

It is preferred that the terminals are arranged symmetrically on both sides with respect to the receiving grooves in the terminal arrangement direction of the receiving grooves, and may be elastically bent in a direction in which the contact portions of the both terminals face each other. Since the terminals are arranged on both sides symmetrically with respect to the receiving groove, when the relay member receiving body and the relay member connection body are situated at the regular position, the relay member inserted into the receiving groove receives the facing contact pressure from the contact portion of the terminals on both surfaces to maintain a stable position.

Further, even though the relay member receiving body is displaced from the regular position in the elastically bending direction of the terminals with respect to the relay member connection body, the relay member always receives the facing contact pressures on the both surfaces thereof. Accordingly, the facing contact pressures balance out each other to reduce a difference in the contact pressures as resultant. Therefore, a load to the relay member connection body becomes small. As a result, comparing to when the terminals are provided on only one side with respect to the receiving groove, and the relay member inserted into the receiving groove receives a contact pressure on only one side, the position of the relay member does not largely displaced.

It is preferred that the contact portions of the terminals facing each other are situated to be mutually displaced in a terminal arrangement direction of the receiving groove. When the contact portions of the terminals facing each other are mutually displaced in the terminal arrangement direction of the same receiving groove, the contact pressure in an opposite direction is applied evenly on both surfaces of the entire relay member thereof. As a result, the position of the relay member around an axis line of an insert direction of the relay member is to be stable.

It is preferred that the engaged portion is provided as an arm portion extending in the assembly direction thereof, and that the engagement portion is provided as an engagement step portion to engage with the engaged portion in the assembly direction thereof. Accordingly, the arm portion can be longer, and an enough amount of an elastic deformation can be secured. Further, an allowable displacement amount occurred in a direction perpendicular to both the assembly direction of the connector and the elastically bending direction of the contact portion may be increased.

The arm portion may be provided with two side portions and a joining portion. The two side portions extend parallel to each other in an assembly direction. A groove portion having a window shape extends to a position close to the distal edge portion in the assembly direction between the both end portions of the arm portion. Further, the joining portion connects the two side portions at the distal portions of the side portions. It is preferred that the engagement portion is provided as a protrusion to engage with the joining portion in the assembly direction of the connector.

Since the groove portion is provided with the engagement portion, the side portion that is an elastically deformed is spindly and easy to bend. Accordingly, a larger amount of elastic deformation can be obtained. Therefore, an allowable amount of displacement occurred in a direction perpendicular to the assembly direction thereof and an elastically bending direction of the contact portion can be increased. Further, since the distal portions of the side portions are connected, the elastically deformed portions support each other to prevent reduction in strength at the distal of the engaged portion.

It is preferred that a plurality of pairs of the engaged portions and the engagement portions is provided in an elastically bending direction of the contact portion of the terminals.

In the present invention, even though the relay member receiving body is displaced from the regular position in the elastically bending direction of the relay member connection body, the terminal always abuts against the relay member receiving body and receives the pre-compression. Accordingly, the minimum contact pressure between the contact portion of the terminal and the relay member is always secured, and the contact between the contact portion of the terminal and the relay member is always secured.

Further, since the terminal receives the pre-compression in the distal portion on the other end side or the free edge of the terminal, the maximum deformation amount of the terminal may be larger than when the terminal receives the pre-compression at a portion other than the distal portion. Therefore, the elastic bend of the terminal enables the allowable range of displacement to be large.

BRIEF DESCRIPTION OF THE DRAWINGS

FIGS. 8(A) and 8(B) are views showing a relay member and terminals of the electrical connector, wherein FIG. 8(A) is a view showing a contact state according to the embodiment of the present invention and FIG. 8(B) is a view showing a contact state according to another embodiment of the present invention; and FIGS. 9(A) and 9(B) are views showing an engagement portion and an engaged portion of an electrical connector according to a further embodiment of the present invention, wherein FIG. 9(A) is a view of the engagement portion formed as a protrusion portion and FIG. 9(B) is a view of the engagement portion formed a recess portion.

DETAILED DESCRIPTION OF THE PREFERRED EMBODIMENTS

Hereunder, embodiments of the present invention will be explained with reference to the accompanying drawings.

Figure 1:
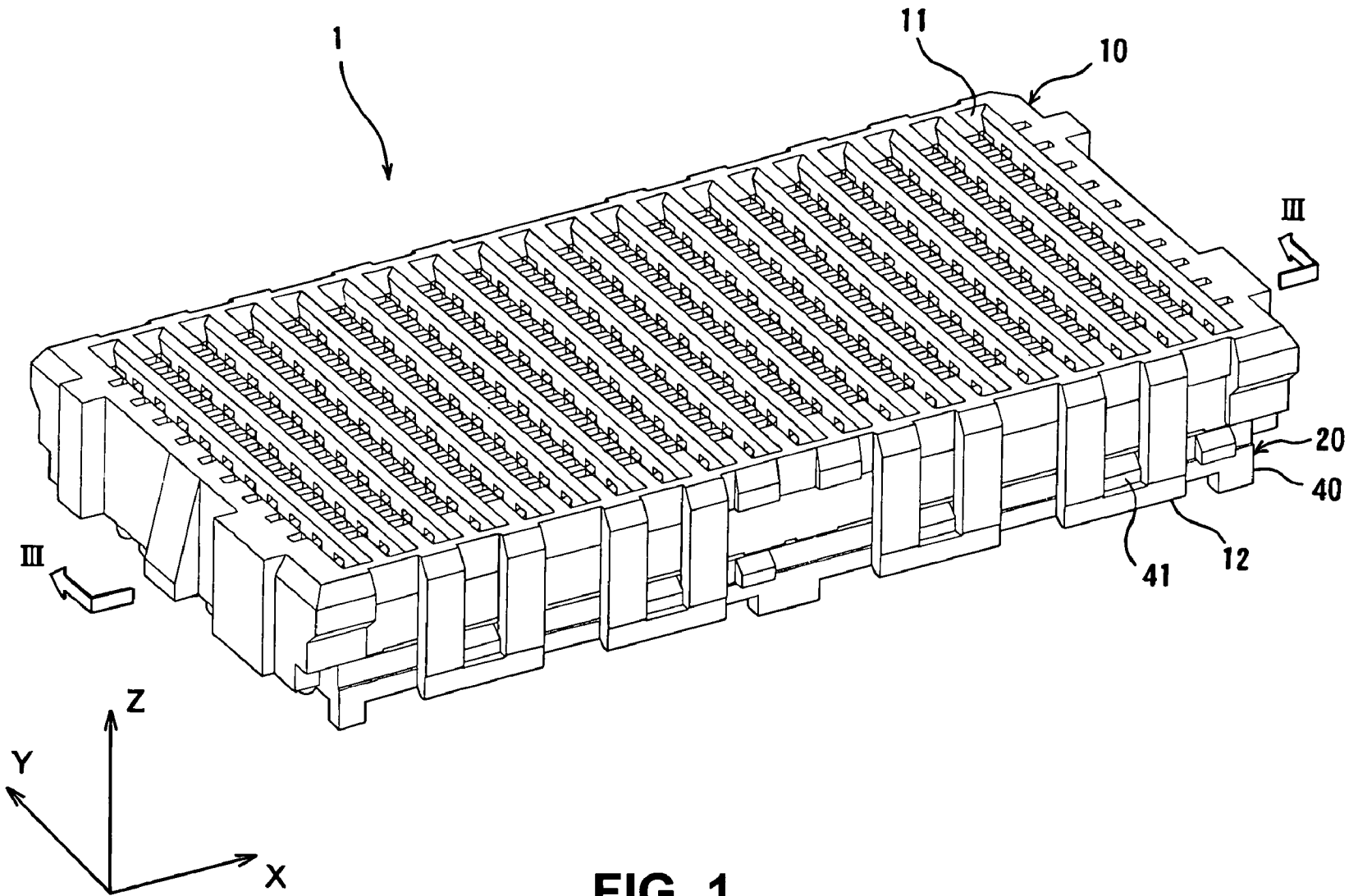
FIG. 1 is a perspective view showing an electrical connector according to an embodiment of the present invention.

FIG. 1 is a perspective view showing an entire electrical connector according to an embodiment of the present invention. As shown in FIG. 1, an electrical connector 1 (connector 1) having an approximate rectangular solid outer shape comprises a relay member receiving body 10 and a relay member connection body 20. The relay member receiving body 10 receives a relay member (not shown). The relay member connection body 20 contacts with the relay member inserted, and holds and arranges a plurality of electrically connected terminals.

Figure 2:
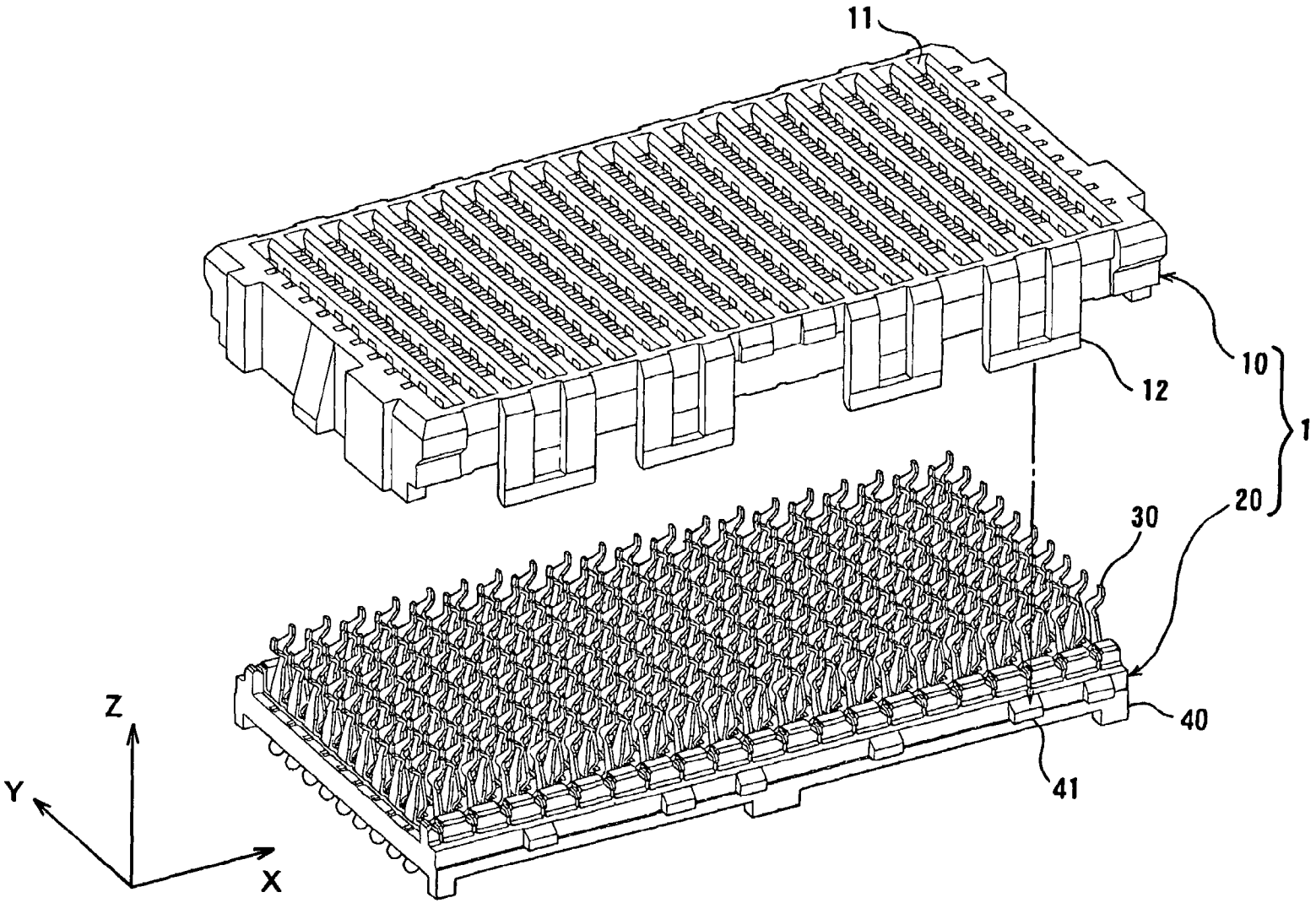
FIG. 2 is an exploded view showing the electrical connector according to the embodiment of the present invention.

FIG. 2 is an exploded perspective view of the connector 1 in FIG. 1. In the embodiment, as shown in FIG. 2, the three directions that are at right angles to one another in three dimensions are referred to as X, Y, and Z directions. That is, a longitudinal direction of the connector 1 is X direction, a lateral direction is Y direction, and a height direction is Z direction.

The relay member receiving body 10 made of a resin is provided with a plurality of receiving grooves 11 extending in the Z direction thereof. The relay member (not shown) having a width in the Y direction thereof and a plate shape may be inserted into the receiving grooves 11. Each of the receiving grooves 11 is provided with an opening portion extending in the Y direction or a width direction of the relay member on a top surface of the relay member receiving body 10.

The relay member connection body 20 comprises a plurality of terminals 30 and a terminal holding body 40 made of a resin to arrange and hold the plurality of the terminals 30. The plurality of the terminals 30 is provided on an upper surface side of the terminal holding body 40 and arranged in rows. Further, the plurality of the terminals 30 erects in a direction perpendicular to a terminal arrangement surface or the Z direction.

The terminal arrangement surface (XY plane) is a virtual surface extending in an arrangement direction of the terminals 30. The plurality of the terminals 30 having an identical shape is made by bending a metal sheet and may be elastically bent in a plate thickness direction thereof. The plate surfaces of all the terminals 30 extend in a direction perpendicular to the X direction thereof. Further, distal portions of all the terminals 30 are situated in a same height.

As described above, the terminals 30 are arranged in rows in the Y direction thereof. A plurality of the terminal 30 forms a plurality of rows (to be referred to as "terminal row") in the X direction thereof. The plurality of the terminal rows is arranged alternatively facing with one another with respect to the X direction thereof. Further, each of the terminal rows constitutes a pair with an adjacent terminal row. The pair of the terminal rows is to be referred to as a "terminal pair".

In the embodiment, each of the terminals 30 is provided with a contact portion to contact with a relay member in one of the plate surfaces as will hereinafter be described. Further, each of the terminal pairs comprises a combination of the terminal rows. The contact portions of the plurality of the terminal rows are facing each other with respect to the Y direction. A pair of the terminal rows is displaced in the same amount in the Y direction thereof in each of the terminal pairs and the terminals are situated alternatively when viewed all the terminal pairs from above in the Z direction thereof.

A plurality of engaged portions 12 having an arm shape is provided side by side in a side face of the relay member receiving body 10 extending to face with the engaged portions 12 in the X direction or a longitudinal direction of the connector 1. The engaged portions 12 are provided to fit with the relay member connection body 20. On the other hand, on side surfaces of the terminal holding body 40 in the X and Z directions, the engagement portions 41 having a protrusion shape to engage with the engaged portions 12 upon fitting are provided in corresponding positions with the plurality of the engaged portions 12 provided in the X direction thereof.

When the relay member receiving body 10 is fitted into the relay member connection body 20 from above in the Z direction of the relay member connection body 20 or an arrow direction indicated by a projected line in FIG. 2, the engagement portions 41 of the terminal holding body 40 engage with the engaged portions 12 in the Z direction thereof as shown in FIG. 1. The engaged portions 12 are provided in corresponding positions with the engagement portions 41 in the relay member receiving body 10. Accordingly, the connector 1 shown in FIG. 1 is completed.

Figure 3:
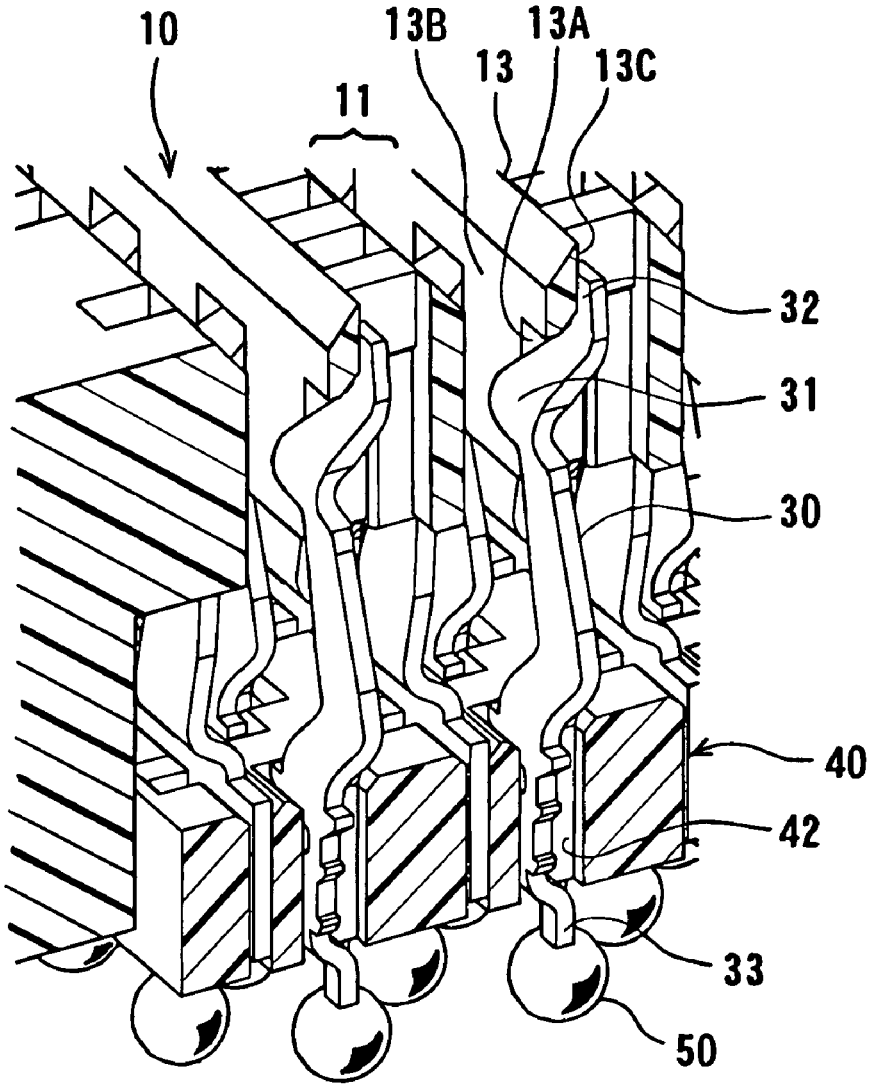
FIG. 3 is a perspective sectional view of the electrical connector taken along a line III-III in FIG. 1 according to the embodiment of the present invention.
Figure 3:
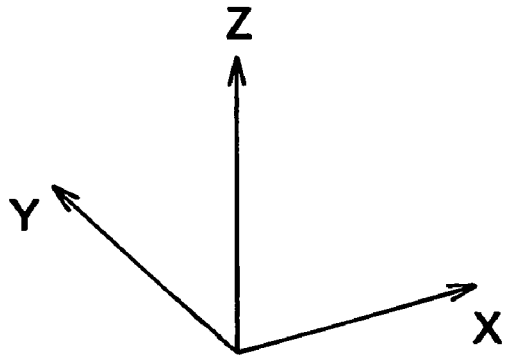

FIG. 3 is a perspective view showing a part of a sectional view of the connector 1 shown in FIG. 1 taken along a line III-III. The terminal holding body 40 is provided with a plurality of terminal holding holes 42 passing through a plate surface of the terminal holding body 40. An edge side of each of the terminals 30 is pressed to fit into and held at the terminal holding hole 42.

On the other edge of the terminal 30 or an upper edge side in FIG. 3, a contact portion 31 to contact with the relay member (not shown) is provided as a protrusion surface formed crookedly. The contact portion 31 is positioned toward inside of the receiving groove 11. As will hereinafter be described, the contact portion 31 may contact with the relay member inserted into the receiving groove 11 to elastically bend in the X direction thereof.

A wall portion 13 forming the receiving groove 11 of the relay member receiving body 10 is situated in the same position with each of the terminal rows in the X direction thereof. Further, the wall portion 13 has a section having a pectinate shape opening downwardly as shown in FIG. 3 in the Y direction thereof. Further, a groove portion 13A that is a pectinate portion passes through a plate thickness direction of the wall portion 13 and is situated in a corresponding position with each of the terminal 30 in the Y direction thereof. The contact portion 31 of an upper edge side of the terminal 30 is situated and accommodated to the groove portion 13A.

Further, a distal portion 32 situated on an upper edge side with respect to the contact portion 31 is adjacent to an adjacent surface 13C in an opposite side of an inside surface 13B of the receiving groove 11 in the wall portion 13 in an upper rim portion of the groove portion 13A. Accordingly, the terminal 30 receives pre-compression in the adjacent surface 13C in a direction away from the relay member or an away direction in an elastic bending direction or the X direction of the contact portion 31.

The terminal 30 passes through the terminal holding hole 42 of the terminal holding body 40 as shown in FIG. 3. A connection portion 33 protrudes from a lower surface of the terminal holding body 40 and is provided with a solder ball 50. The connection portion 33 is connected with a distal portion on a lower edge side of the terminal 30 or a corresponding circuit portion of the circuit board (not shown). The connection portion 33 may be connected to a corresponding circuit portion of the circuit board with solder because of a solution or solidification of the solder ball 50.

Figure 4:
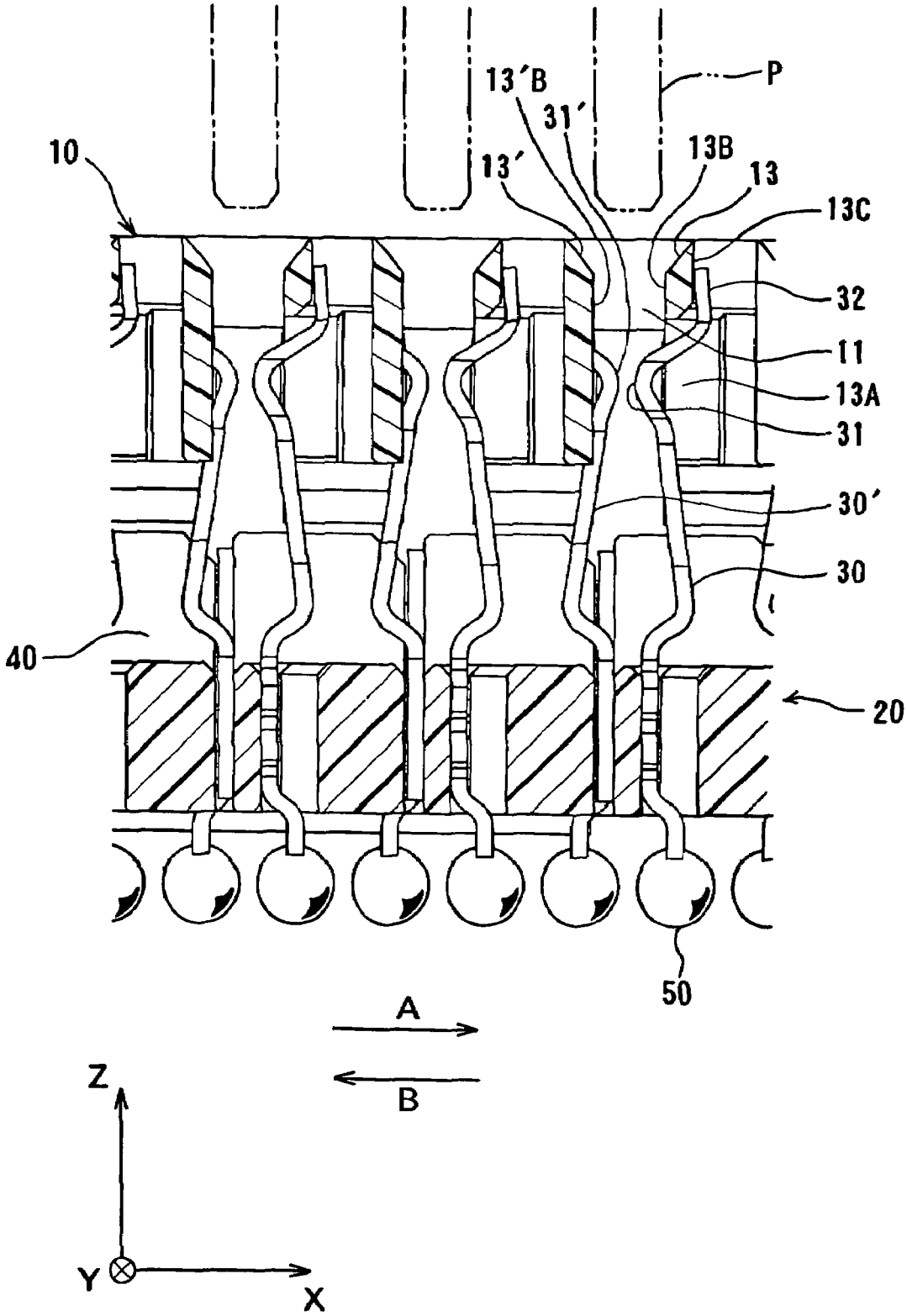
FIG. 4 is a perspective sectional view of the electrical connector taken along a line III-III in FIG. 1 and viewed from a direction Y according to the embodiment of the present invention.

FIG. 4 is a part of a sectional view of the connector 1 shown in FIG. 1 taken along a line III-III and viewed from the Y direction. In each of the receiving grooves 11, the terminal rows of the terminal pair are arranged symmetrically on both sides. Hereunder, the terminal of one terminal row of one of the terminal pair is referred to as the terminal 30, while the terminal of the other terminal row of the terminal pair is referred to as a terminal 30' for simplicity.

Further, the wall portion situated in the same position as the terminal 30 in the X direction thereof is referred to as the wall portion 13, while the wall portion situated in the same position as the terminal 30' is referred to as a wall portion 13'. The contact portion 31 and a contact portion 31' of the terminals 30 and 30' facing each other inside of the same receiving groove 11 with respect to the Y direction thereof are provided in the same position in a height direction of the connector and protrude to face each other from the wall portions 13 and 13' to inside of the receiving groove 11.

Further, a space between the contact portion 31 and the contact portion 31' is narrower than a plate thickness of a relay member P indicated by a phantom line. The relay member P is a circuit board to electrically connect the connector 1 and the mating connector. A transmission circuit (not shown) and a connection pad (not shown) are provided on both surfaces of the relay member P. The connection pad is an end portion of a transmission circuit.

As described above, the terminal 30 receives the pre-compression in a direction in which the distal portion 32 is adjacent to the adjacent surface 13C of the wall portion 13 and is away from the relay member P in the X direction thereof (arrow A direction). Similarly, the terminal 30' receives the pre-compression in a direction in which the terminal 30' is adjacent to the adjacent surface of the wall portion 13' and is away from the relay member P in the X direction thereof (arrow B direction) in a position where the terminal 30' is displaced in the Y direction of the terminal 30 (not shown).

Figure 5:
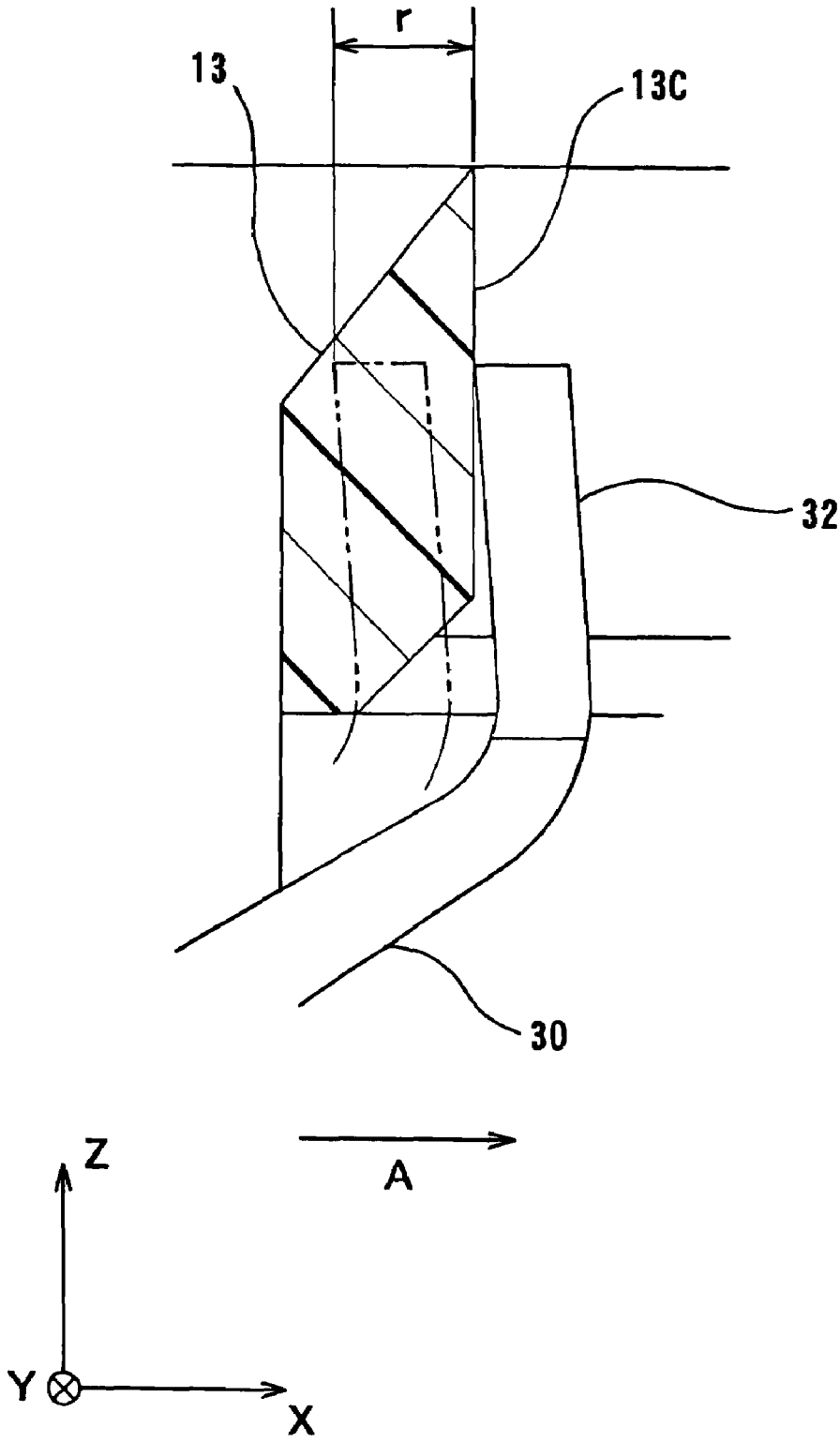
FIG. 5 is an enlarged sectional view of the electrical connector shown in FIG. 4 according to the embodiment of the present invention.

FIG. 5 is a partially enlarged sectional view of the connector shown in FIG. 4. In FIG. 5, the distal portion 32 of the terminal 30 is adjacent to the adjacent surface 13C of the wall portion 13 and receives the pre-compression.

As shown in FIG. 5, the distal portion 32 of the terminal 30 is adjacent to the adjacent surface 13C of the wall portion 13 and is displaced for a distance r from a free position indicated by the phantom line to a direction in which the terminal 30 is away from the relay member in the X direction or an elastic bending direction of the terminal 30 (arrow A direction) to receive the pre-compression. Similarly, the terminal 30' facing with the terminal 30 inside of the receiving groove 11 is elastically displaced to an opposite direction of that of the terminal 30 and receives the pre-compression.

When the relay member P indicated by the phantom line in FIG. 4 is inserted into the receiving groove 11 from above in the Z direction thereof, the relay member P pushes through the space between the contact portion 31 of the terminal 30 and the contact portion 31' of the terminal 30' to enter a lower portion. Since the relay member P pushes the contact portions 31 and 31', the terminal 30 and the terminal 30' are elastically displaced in the arrow A and B directions, respectively.

When the relay member P is inserted completely, the contact portions 31 and 31' elastically contact with the connection pads through compressing the connection pads provided on both surfaces of the relay member P. Accordingly, the contact pressure of the contact portions 31 and 31' and the connection pads of the relay member P is secured. Further, the electrical contact between the connector 1 and the relay member P is to be stable.

In the embodiment, as described above, in a direction away from the relay member P inserted, the pre-compression is given to the terminals 30 and 30'. Accordingly, even though a relative position of the relay member receiving body 10 and the relay member connection body 20 is displaced from a regular position in the X direction thereof because of a manufacturing error or a fitting error of the members, a minimum contact pressure between the contact portions 31 and 31' and the relay member is always secured.

More specifically, for example, when the relative position of the relay member receiving body 10 and the relay member connection body 20 shown in FIG. 4 is not the regular position and when the relay member receiving body 10 and the relay member connection body 20 are fitted into each other to displace from the regular position to the arrow A direction due to the errors, the distal portion 32 is displaced from the regular position to the arrow A direction. The distal portion 32 is an adjacent portion to be adjacent to the wall portion 13 of the terminal 30. Accordingly, the terminal 30 receives more pre-compression than in the regular position.

At the same time, the distal portion of the terminal 30' is displaced from the regular position to the arrow A direction and the terminal 30' receives less pre-compression than in the regular position. The terminal 30' is an adjacent portion to be adjacent to the wall portion 13' of the terminal 30'. That is, even though the relay member receiving body 10 is displaced with respect to the relay member connection body 20 from the regular position to the arrow A direction, the terminals 30 and 30' always receive the pre-compression.

When the relay member receiving body 10 and the relay member connection body 20 are fitted into each other to displace from the regular position to the arrow B direction due to the errors, the distal portion 32 is also displaced from the regular position to the arrow B direction. The distal portion 32 is an adjacent portion to be adjacent to the wall portion 13 of the terminal 30. Accordingly, the terminal 30 receives less pre-compression than the pre-compression when situated in the regular position.

At the same time, the distal portion of the terminal 30' is displaced from the regular position to the arrow B direction and the terminal 30' receives more pre-compression than in the regular position. The terminal 30' is an adjacent portion to be adjacent to the wall portion 13' of the terminal 30'. That is, even though the relay member receiving body 10 is displaced with respect to the relay member connection body 20 from the regular position to the arrow B direction, the terminals 30 and 30' always receive the pre-compression.

The distal portions of the terminals 30 and 30' receive the pre-compression from the adjacent surface of the relay member receiving body 10 in the X direction thereof. Even though the relay member receiving body 10 is displaced in any of the X direction of the relay member connection body 20, the terminals 30 and 30' elastically deformed to bend in the displacement direction. Accordingly, the distal portions are always adjacent to the adjacent surfaces.

Then, the contact portions 31 and 31' of the terminals are displaced following the distal portion. Accordingly, the relative position of the contact portions with respect to the adjacent surface is to be approximately the same. Therefore, the contact portions 31 and 31' are situated in the regular position with respect to the inside surface 13B and an inside surface 13'B of the receiving groove 11 that are the back sides of the adjacent surface on the wall portions 13 and 13'. Accordingly, the contact portions 31 and 31' are situated in such a position in which stable contact pressure with the relay member P inserted into the receiving groove 11 may be secured.

Therefore, even though the relay member receiving body 10 is displaced from the regular position to arrows A or B direction in the X direction of the relay member connection body 20, the contact portions 31 and 31' can always elastically contact with the relay member P. Accordingly, the minimum contact pressure between the contact portion 31 and 31' and the relay member P is always secured. Further, a contact between the contact portions 31 and 31' and the relay member P may be stable.

Similarly, when there is no manufacturing error or the like, when the relay member receiving body 10 fits into the relay member connection body 20 at a regular position, and when an external force is applied to the connector 1 in the X direction thereof to displace the relay member receiving body 10 from the regular position, the minimum contact pressure from the contact portions 31 and 31' applied to the relay member P is always secured. Accordingly, a contact between the contact portions 31 and 31' and the relay member P may be stable.

Further, in the embodiment, the terminals 30 and 30' receive the pre-compression at the distal portion 32 on an upper edge side or a free edge of the terminals 30 and 30'. Accordingly, a maximum deformation amount of the terminals 30 and 30' becomes larger than when the terminals 30 and 30' receive the pre-compression at a portion other than the distal portion 32 or a middle portion. Therefore, the elastic bend of the terminals 30 and 30' enables the allowable range of displacement to be large.

Further, in the embodiment, the terminals 30 and 30' are symmetrically arranged on both ends with respect to the receiving groove 11 in a terminal arrangement direction or the Y direction of the same receiving groove 11. Even though a relative position of the relay member receiving body 10 and relay member connection body 20 is displaced from the regular position in elastically bending direction or the X direction of the contact portion, the relay member P receives the facing contact pressure from the contact portions 31 and 31' of the terminals 30 and 30' on both surfaces.

Accordingly, the facing contact pressures balance out each other to reduce a difference of the contact pressure as resultant; and therefore, a load to the relay member connection body is to be small. As a result, the contact pressure received by the relay member at a direction is so small that the position of the relay member is not largely displaced compare to when the terminal is provided only on one side with respect to the receiving groove 11 and the relay member is inserted into the receiving groove 11 to receive the contact pressure only on one surface of the relay member.

Further, in the embodiment, the contact portions 31 and 31' of the terminals 30 and 30' facing each other are mutually displaced in a terminal arrangement direction or the Y direction thereof. Accordingly, the contact pressure from an opposite direction is applied evenly on both surfaces of the entire relay member in the Y direction thereof. As a result, the position of the relay member P in an insert direction of the relay member P or around an axis line in the Z direction becomes stable.

Figure 6:
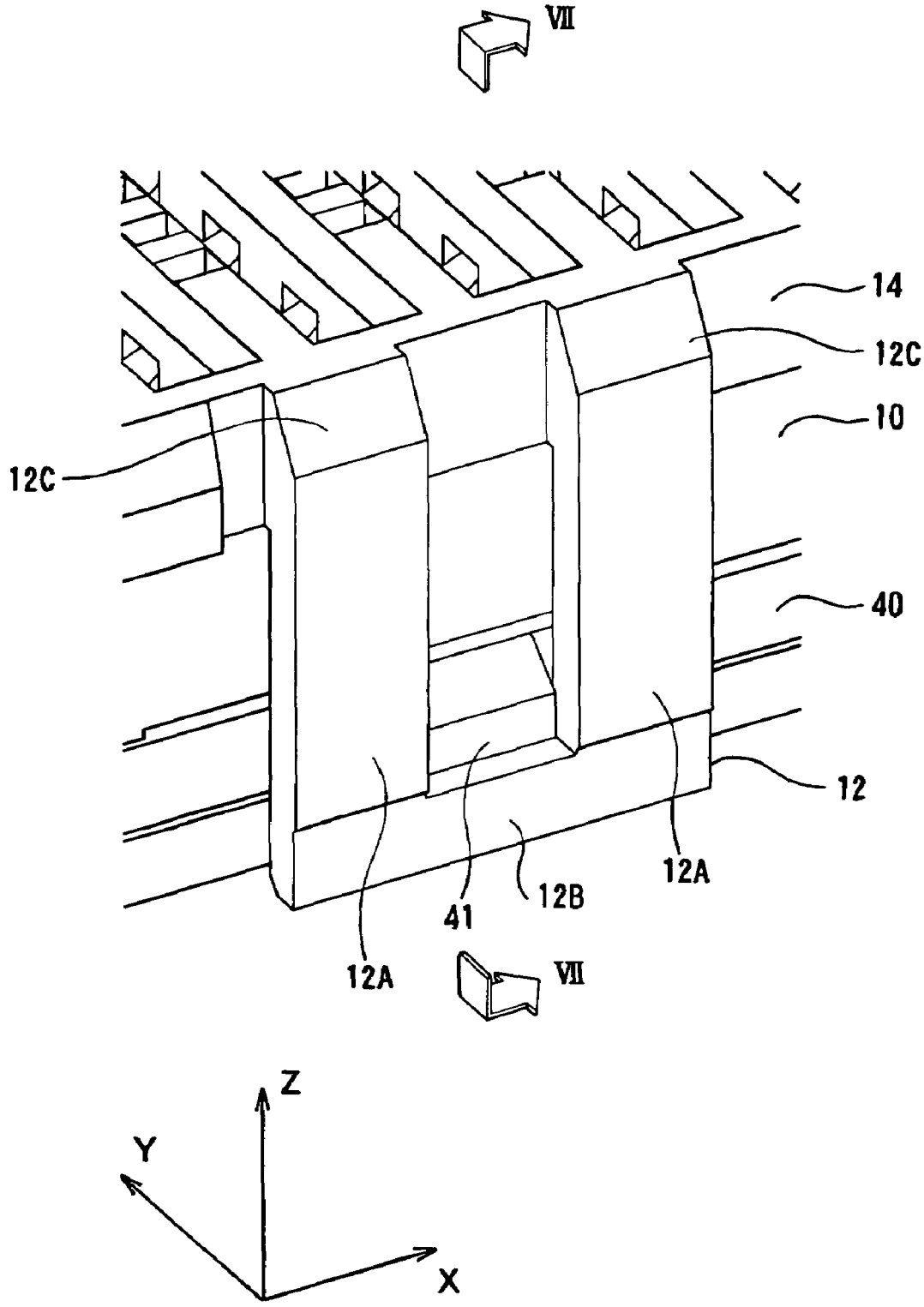
FIG. 6 is a perspective view showing an engagement portion and an engaged portion of the electrical connector in an engaged state according to the embodiment of the present invention.

FIG. 6 is a perspective view showing the engaged portion 12 of the relay member receiving body 10 and the engagement portion 41 of the relay member connection body 20 of the connector 1 shown in FIG. 1. The engaged portion 12 of the relay member receiving body 10 and the engagement portion 41 of the relay member connection body 20 are engaged with each other.

The engaged portion 12 is provided with two side portions 12A and a joining portion 12B. The two side portions 12A extend parallel to each other in an assembly direction of the relay member receiving body 10 and the relay member connection body 20 thereof or the Z direction. The joining portion 12B connects distal portions of the side portions 12A and extends in the Y direction thereof.

The side portions 12A and the joining portion 12B have a groove portion having a window shape extending in the Z direction to a position close to a distal edge portion between the both end portions of the arm portion extending in the Z direction thereof. The engagement portion 41 is provided as a protrusion portion on a side face of the terminal holding body 40 extending in the Y direction of the terminal holding body 40 and engages with the joining portion 12B in the Z direction thereof. The upper face of the engagement portion 41 is a slope and the lower surface of the engagement portion 41 is a step.

Upper edge portions 12C of the two side portions 12A of the engaged portion 12 are taper surfaces and extend in an arm shape downwardly from an upper rim portion 14 extending in the Y direction of the relay member receiving body 10. Further, a space is provided between the side portion 12A except for the upper edge portion 12C and the side surface of the relay member receiving body 10 in the Y direction thereof as shown in FIG. 6. The engaged portion 12 functions as a cantilever. The upper edge portion 12C of the side portion 12A is a fixed end of the engaged portion 12. Accordingly, the engaged portion 12 may be elastically bent in the Y direction thereof.

In the embodiment, even though the relay member receiving body 10 is displaced from a regular position in the Y direction of the relay member connection body 20 due to a manufacturing error or the like, the engaged portion 12 is pushed by the side face of the terminal holding body 40 in the Y direction thereof to elastically deform in the Y direction thereof. Accordingly, the elastic deformation absorbs an impact of the displacement.

Similarly, when no manufacturing error or the like occurs and the relay member receiving body 10 is in the regular position with respect to the relay member connection body 20 upon fitting of the connector, an impact of displacement is absorbed because of an elastic deformation of the engaged portion 12 in the Y direction thereof even though the connector 1 receives external force in the Y direction thereof to displace the relay member receiving body 10 from the regular position.

In the embodiment, since the engaged portion 12 is provided with the side portions 12A extending in the Z direction thereof, an amount of elastic deformation can be secured because of the length of the side portions. Accordingly, an allowable amount of displacement occurred in the Y direction thereof can be increased.

Further, in the embodiment, the engaged portion 12 is provided with the groove portion and the elastically deformed portions are spindly and easy to bend. Accordingly, a larger amount of elastic deformation can be obtained. Therefore, an allowable amount of displacement in the Y direction thereof can be increased. Further, even though the side portions are spindly, the distal portions of the side portions 12A are connected through the joining portion 12B. Accordingly, the elastically deformed portions support each other to prevent reduction of the strength at the distal of the engaged portion 12.

Figure 7:
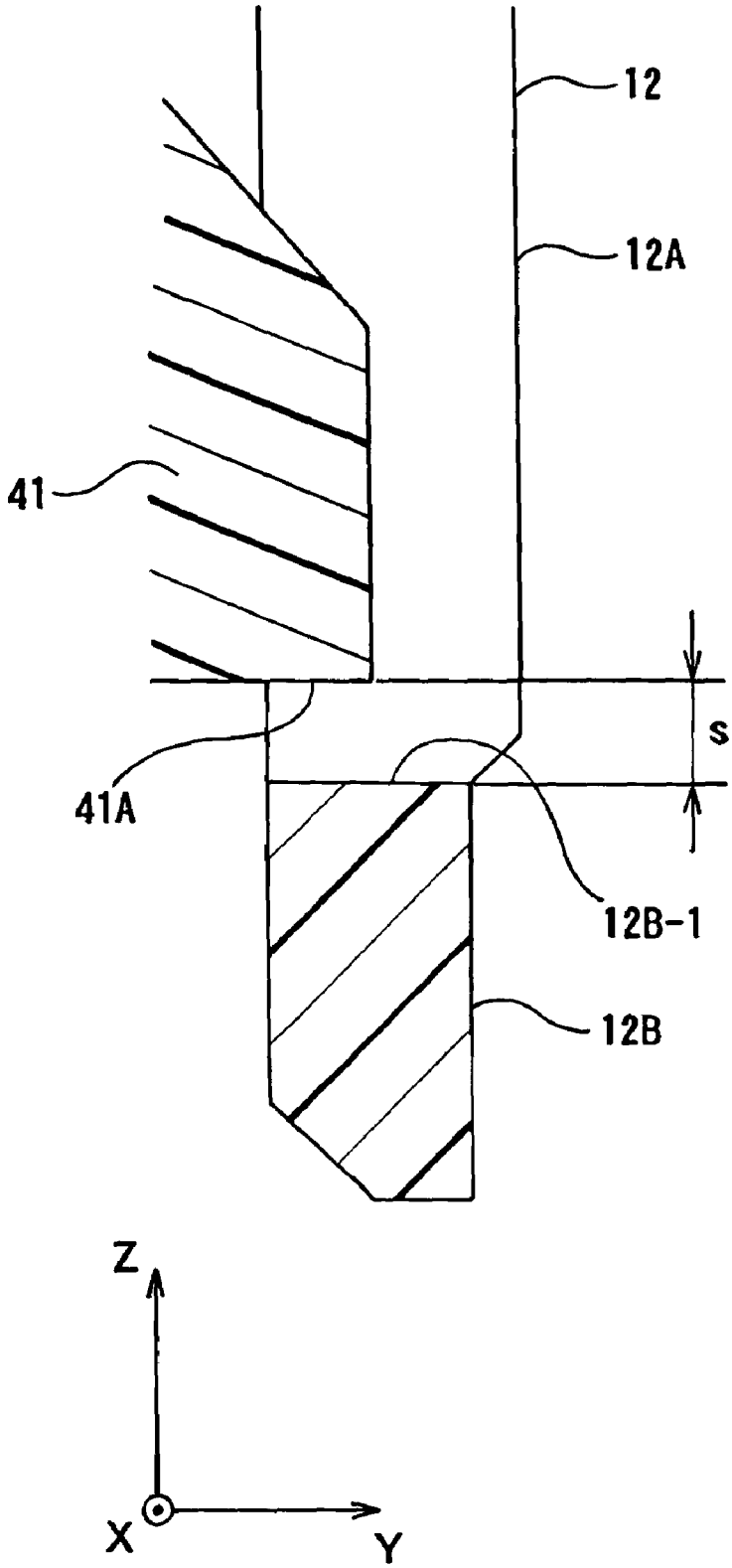
FIG. 7 is a sectional view of the electrical connector taken along a line VII-VII in FIG. 6 according to the embodiment of the present invention.

FIG. 7 is a sectional view showing a part of FIG. 6 taken along a line VII-VII. As shown in FIG. 7, the engagement portion 41 engages with the engaged portion 12 having a play of a distance s in the Z direction thereof. That is, a space of the distance s is formed between an upper face 12B-1 of the joining portion 12B of the engaged portion 12 and a lower surface 41A of the engagement portion 41 in the Z direction thereof.

In the embodiment, the engaged portion 12 and the engagement portion 41 are formed with a play of the distance s in the Z direction thereof. Accordingly, even though the relay member receiving body 10 is displaced from the regular position in the Z direction of the relay member connection body 20 due to a manufacturing error or the like, the play may absorb the impact of displacement.

Similarly, when no manufacturing error or the like occurs and the relay member receiving body 10 is in the regular position with respect to the relay member connection body 20, an impact of displacement is absorbed because of the a play provided between the engaged portion 12 and the engagement portion 41 even though the connector 1 receives an external force in the Z direction thereof to displace the relay member receiving body 10 from the regular position.

In the connector 1 according to the embodiment, displacements in all the X, Y and Z directions can be absorbed by giving the pre-compression to the terminals 30 and 30' in the X direction thereof; elastically deforming to bend the engaged portion 12 in the Y direction thereof; and engaging the engaged portion 12 with the engagement portion 41 with a play in the Z direction thereof.

In the embodiment, the contact portion of the terminal protrudes from the wall portion of the receiving groove when the receiving groove is viewed from the Y direction thereof. As a variation, the terminal in which the contact portion of the terminal does not protrude from the wall portion may be provided.

FIGS. 8(A) and 8(B) are schematic views showing the contact of the relay member and the terminal comparing the described embodiment and the variation. FIG. 8(A) is a state of contact in the described embodiment, while FIG. 8(B) is a state of contact in the variation. FIGS. 8(A) and (B) explain a contact state of the relay member of the terminal and the contact portion.

The shape of the terminal is simplified and the distal portion of the terminal receiving the pre-compression is not shown. The terminals facing each other are not displaced in the Y direction thereof in the figures and the terminals situated in the same position in Y direction thereof are shown.

As shown in FIG. 8(A), in the embodiment described above, the contact portions 31 and 31' of the terminals that are facing each other protrude from the inside surface 13B and 13'B of the receiving groove 11 to inside of the receiving groove 11 when the receiving groove 11 is viewed from the Y direction thereof. Further, when the relay member P is inserted into the receiving groove 11, the relay member P pushes to stretch the space between the contact portion 31 and the contact portion 31' to enter a lower portion. Accordingly, the contact portions 31 and 31' compress flat connection pads (not shown) provided on both surfaces of the relay member P to elastically contact with the connection pads.

On the other hand, in the variation as shown in FIG. 8(B), terminals 60 and 60' facing each other are approximate straight in the Y direction thereof. Further, contact portions 61 and 61' of the terminals 60 and 60' form planes facing each other. When the receiving groove 11 is viewed from the Y direction thereof, the contact portions 61 and 61' of the terminals 60 and 60' facing each other protrude from the inside surfaces 13B and 13'B of the receiving groove 11, respectively.

On the other hand, as shown in FIG. 8(B), a connection pad P'-1 provided on both surfaces of a relay member P' protrudes from a surface of the relay member P'. When the relay member P' is inserted into the receiving groove 11, the connection pad P'-1 and the connection pad P'-1' push to stretch a space between the terminals 60 and 60' to enter a lower portion. Accordingly, the contact portions 61 and 61' of the terminals 60 and 60' compress the connection pads P'-1 and P'-1' to elastically contact with the connection pads P'-1 and P'-1'.

In the variation, even though the relay member receiving body is displaced from the regular position in the X direction of the relay member connection body, the contact portions 61 and 61' always elastically contact with the relay member P'. Accordingly, the minimum pressure between the contact portions 61 and 61' and the relay member P' is always secured. As a result, a contact between the contact portions 61 and 61' and the relay member P' is to be stable.

In the embodiment, the engaged portion is provided with the two side portions and the joining portion. The side portion is formed through the groove portion extending in an assembly direction thereof. The joining portion connects the distal portions of the side portions.

Figure 9B:
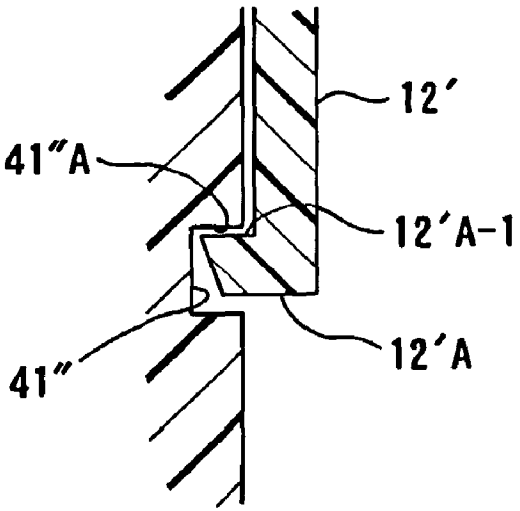
Figure 9A:
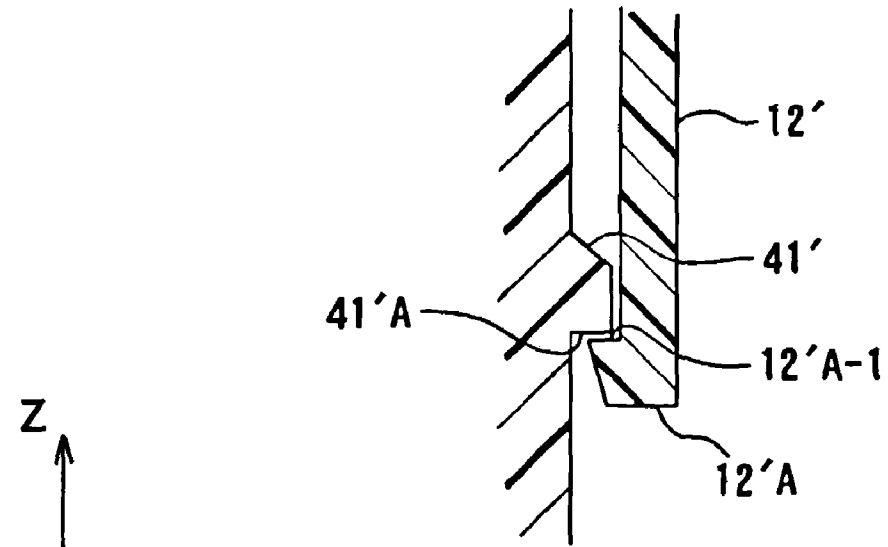

Alternatively, as a variation, the engaged portion may be provided as an arm portion extending in the assembly direction without the side portions and the joining portion. FIGS. 9(A) and 9(B) are sectional view showing the engaged portion and the engagement portion taken along planes YZ according to the two variations.

In the variation, an engaged portion 12' is provided as an arm portion extending in an assembly direction or the Z direction thereof. Further, a coronoid portion 12'A is provided in a distal of the arm portion. Further, the engagement portion to engage with the engaged portion 12' is provided as an engagement step portion to engage with the coronoid portion 12'A of the engaged portion 12' in the assembly direction of the connector. For example, the engagement portion may be provided as a protrusion portion or a recess portion.

In a variation shown in FIG. 9(A), the engagement portion is provided as a protrusion portion. As shown in FIG. 9(A), a lower surface 41'A of an engagement portion 41' engages with an upper face 12'A-1 of the coronoid portion 12'A of the engaged portion 12' in the Z direction with a play. The engagement portion 41' is provided as a protrusion portion having a slope upper surface. The lower surface 41'A of the engagement portion 41' has a step shape.

In a variation shown in FIG. 9(B), the engagement portion is formed as a recess portion. An inside space of the recess portion has a rectangular solid shape. As shown in FIG. 9(B), a surface 41"A of an engagement portion 41" engages with the upper face 12'A-1 of the coronoid portion 12'A of the engaged portion 12' in the Z direction thereof with a play. The engagement portion 41" is provided as the recess portion. The surface 41"A of the engagement portion 41" is situated in an upper portion of an inside surface forming the inside space of the recess portion.

In these variations, since the engaged portion is provided as an arm portion extending in the Z direction thereof, the amount of elastic deformation may be secured due to a length of the arm portion. Accordingly, an allowable amount of displacement in the Y direction thereof may be increased. Further, since the engaged portion and the engagement portion may be formed in a simple shape, the relay member receiving body 10 and the terminal holding body 40 may be produced with ease. Accordingly, the cost of production may be reduced.

In the embodiment and the variations described above, the relay member receiving body and the terminal holding body are provided with the engaged portion and the engagement portion, respectively. Alternatively, the relay member receiving body and the terminal holding body may be provided with the engagement portion and the engaged portion, respectively.

Further, in the embodiment and the variations, only the engaged portion but not the engagement portion may be elastically deformed. Alternatively, only the engagement portion may be formed and elastically deformed. Further, both the engaged portion and the engagement portion may be formed and elastically deformed.

In the embodiment and the variations described above, the example in which the relay member having a plate shapes is inserted into the receiving groove of the relay member receiving body. A shape of a member inserted into the receiving groove may not be limited to a plate shape. For example, the member may be a block body provided with a transmission circuit on an external surface and a connection pad as an end portion of the transmission circuit.

The disclosure of Japanese Patent Application No. 2006-330059, filed on Dec. 7, 2006 is incorporated in the application by reference.

While the invention has been explained with reference to the specific embodiments of the invention, the explanation is illustrative and the invention is limited only by the appended claims.

What is claimed is:

1. An electrical connector for a circuit board, comprising:

a connection body including a terminal and a terminal holding body for holding the terminal, said terminal including one end portion fixed to the terminal holding body, a contact portion, and a distal portion; and a receiving body fitted into the connection body, said receiving body including a receiving groove for receiving a relay member to be connected with the terminal, said receiving body further including a window portion for accommodating the contact portion so that the distal portion abuts against an edge of the window portion to bend the terminal away from the relay member.

2. The electrical connector according to claim 1, wherein said receiving body is fitted into the terminal holding body in an assemble direction perpendicular to a terminal arrangement surface on which the terminal is arranged.

3. The electrical connector according to claim 2, wherein at least one of said connection body and said receiving body further includes an engagement portion, the other of said connection body and said receiving body further including an engaged portion for fitting into the engagement portion, at least one of said engagement portion and said engaged portion being elastically deformable so that the engagement portion engages with the engaged portion in the assembly direction with a play.

4. The electrical connector according to claim 1, wherein said terminal is arranged at positions on both sides of the receiving groove symmetrically with respect to the receiving groove, said terminal being elastically deformable in a direction in which the contact portion faces a contact portion of the adjacent terminal.

5. The electrical connector according to claim 1, wherein said terminal is arranged at positions on both sides of the receiving groove symmetrically with respect to the receiving groove, said terminal being arranged along a terminal arrangement direction so that the contact portion is shifted from a contact portion of the adjacent terminal along the terminal arrangement direction.

6. The electrical connector according to claim 3, wherein said engaged portion includes an arm portion extending in the assembly direction, said engagement portion including an engagement step portion for engaging with the engaged portion in the assembly direction.

7. The electrical connector according to claim 6, wherein said arm portion includes two side portions and a joining portion, said two side portions extending parallel to each other in the assembly direction, said joining portion connecting distal portions of the side portions, said engagement portion including a protrusion for engaging with the joining portion in the assembly direction.

8. The electrical connector according to claim 3, wherein said engaged portion and said engagement portion are disposed at a plurality of positions as a pair along the elastically bending direction of the contact portion.

* * * * *